United States Patent [19]

Derrick, Jr.

[11] 4,065,382

[45] Dec. 27, 1977

[54] MULTIPLE SCREEN APPARATUS

[75] Inventor: H. William Derrick, Jr., Williamsville, N.Y.

[73] Assignee: Derrick Manufacturing Corporation, Buffalo, N.Y.

[21] Appl. No.: 696,584

[22] Filed: June 16, 1976

[51] Int. Cl.[2] ..... B07B 1/28

[52] U.S. Cl. ..... 209/313; 209/255

[58] Field of Search ..... 209/311, 313, 314, 353, 209/354, 255, 257, 370, 373, 244, 254, 240

[56] References Cited

U.S. PATENT DOCUMENTS

| | | | |
|---|---|---|---|
| 821,874 | 5/1906 | Kirksey | 209/314 |
| 2,386,579 | 10/1945 | Wheeler | 209/314 |
| 3,688,902 | 9/1972 | Hubach | 209/254 X |

FOREIGN PATENT DOCUMENTS

| | | | |
|---|---|---|---|
| 471,081 | 1/1929 | Germany | 209/313 |

*Primary Examiner*—William A. Cuchlinski, Jr.
*Attorney, Agent, or Firm*—Christel & Bean

[57] ABSTRACT

Vibrating screen apparatus wherein high screening output is achieved by providing a series of inclined screens in generally end to end relation whereby undersize material passing through the screens is received in a common hopper disposed beneath the screens. The oversize material falls from the lower end of each screen and guide means thereat directs the oversize material from the several screens into a common conduit extending longitudinally beneath the screens to conduct the oversize material from the apparatus. A splitter above the apparatus divides the input material into equal parts corresponding to the number of screens and discharges such parts onto the upper ends of the several screens.

6 Claims, 5 Drawing Figures

MULTIPLE SCREEN APPARATUS

BACKGROUND OF THE INVENTION

In industrial screening it has been proposed to increase screen output by employing a relatively long screen surface and depositing material thereon at several points along the screen surface. In such proposals the oversize material from all the points of deposit carries along to the end of the screen and therefore the material to be screened which is deposited on the screen at the last point of deposit is deposited on the oversize material from the previous points of deposit. Accordingly, the efficiency of screening is not uniform throughout the length of the screen and the screening result is not uniform. Furthermore, since the material deposited on the screen at various points therealong travels various distances along the screen surface the screening action is not uniform as to the several deposits.

Another and more obvious alternative, when increased screening capacity is required, is to merely employ additional entirely separate and independent screening apparatuses of conventional form.

SUMMARY OF THE INVENTION

The present invention provides a screen structure wherein the total screen surface consists of several screens in generally end to end relationship with means for depositing starting material uniformly at the beginning end of each screen and with means for collecting the oversize material at the delivery end of each screen, with manifold means for collecting and conducting the oversize material from the several screens to a common discharge point.

With the foregoing arrangement each of the several screens performs its screening function independently and is not affected by the operation of adjacent screens. The attainment of maximum screen output and uniformity of screening is achieved by combining the novel screen arrangement of the present invention with the non-clogging screen structure which is the subject of my co-pending patent application Ser. No. 660,490 filed Feb. 23, 1976 and also by employing the flow divider of my co-pending application Ser. No. 653,364 filed Jan. 29, 1976. This flow divider insures that the starting material introduced to the several screens is highly uniform in composition and in quantity.

DESCRIPTION OF THE ILLUSTRATED EMBODIMENT

Figure 1:
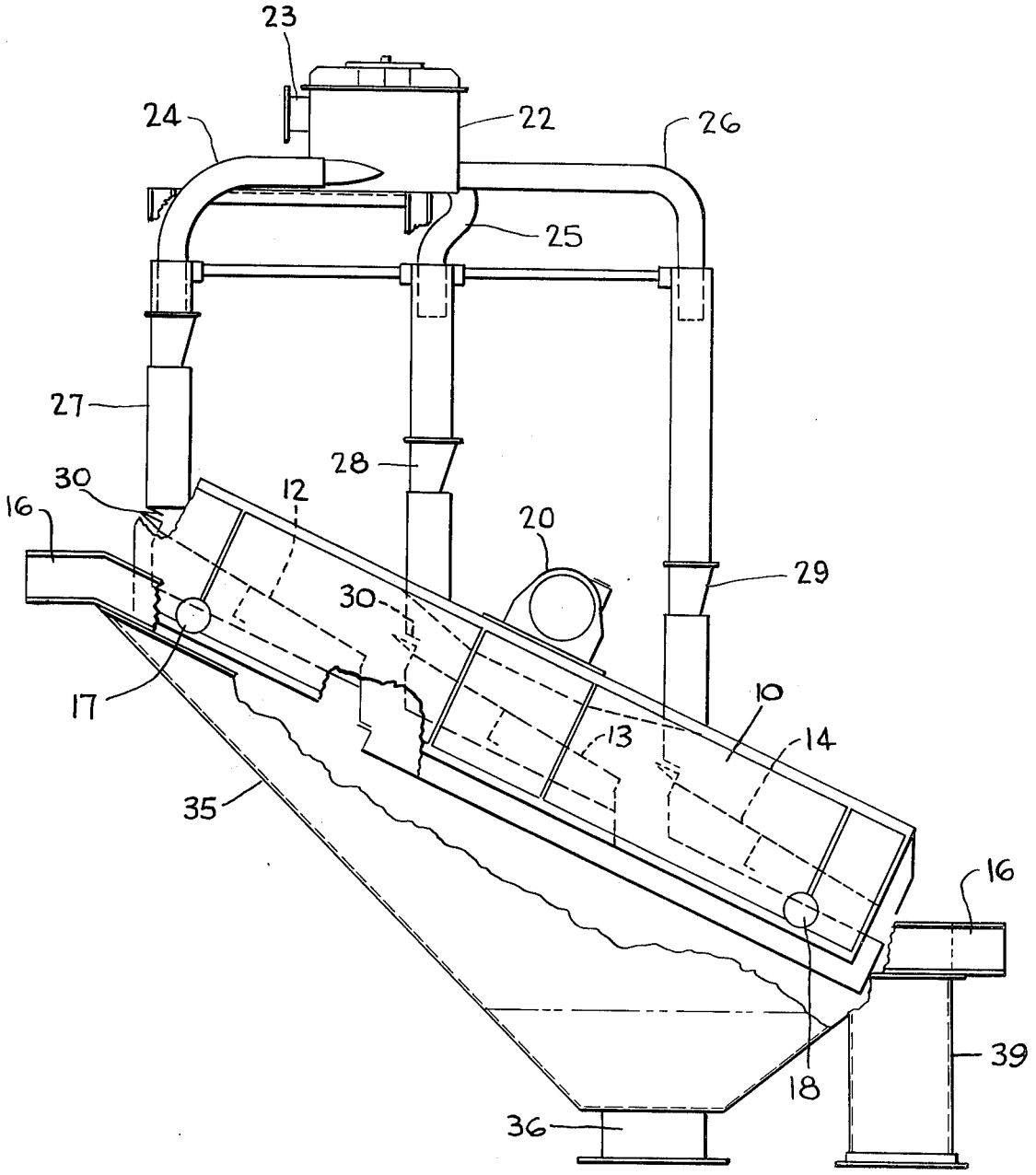
FIG. 1 is a general side-elevational view of one form of the apparatus of the present invention with portions thereof broken away for added illustration.
Figure 3:
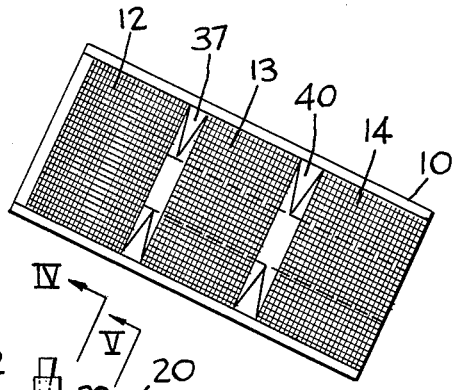
FIG. 3 is a top plan view of the structure of FIG. 2.

The screen apparatus shown in the accompanying drawings includes a generally rectangular inclined screen frame 10 which has clamped therein three separate identical screen elements 12, 13 and 14.

Screen rame 10 is mounted upon a rigid support frame 16 by rubber mountings 17 and 18 which permit the screen frame to vibrate to promote screening of material. Screen frame 10 has mounted thereon the usual vibrating motor 20 which includes an unbalanced mass of one kind or another to produce vibrational impulses and cause the screen frame to vibrate rapidly upon its rubber mountings 17 and 18.

The screens 12, 13 and 14 are removably mounted in frame by conventional means and are preferably of the novel double screen structure shown and described in my co-pending patent application Ser. No. 660,490 filed Feb. 23, 1976. The use of the screen arrangement of this pending patent application produces a novel and highly useful non-clogging result which permits the use of relatively shorter screens to obtain a screening efficiency and uniformity heretofore unattainable. The employment of shorter screens is of particular importance in the present multiple screen arrangement since it materially reduces the overall length of the multiple screen structure.

The starting material to be screened is introduced to a three-way flow divider or splitter designated 22 in FIG. 1 by way of an inlet conduit 23. The material introduced to the splitter 22 is divided therein into three uniform portions or components which are discharged through conduits designated 24, 25 and 26 which lead to outlet members 27, 28 and 29. The means by which the three portions of material are divided into components of uniform density, distribution and quantity is clearly described in my above-identified co-pending application Ser. No. 653,364 filed Jan. 29, 1976.

Material from the discharge members 27, 28 and 29 is deposited upon the upper ends of the screens 12, 13 and 14 respectively. As shown at 30 in FIG. 1 the material from discharge member 27 is spread transversely along the upper end of screen 12 by a flange 30 and similar flanges are provided at the lower ends of the discharge members 28 and 29.

Figure 5:
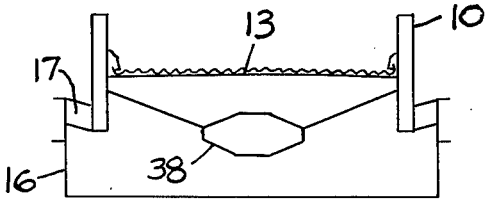
FIG. 5 is a similar cross-sectional view taken on the line V—V of FIG. 2.

The undersize material which passes through the several screens 12, 13 and 14 is received in a hopper 35 having an outlet 36 at its lower end. The oversize material passes down the several screens and drops off of the lower ends thereof. The oversize material from screen 12 drops from the lower end of the screen surface into a transversely extending funnel-like collector 37 which directs the oversize material into a launder 38 which extends beneath the screens 13 and 14 and discharges into an outlet 39 for the oversize material. The cross-section of launder 38 is best shown in FIG. 5.

Figure 2:
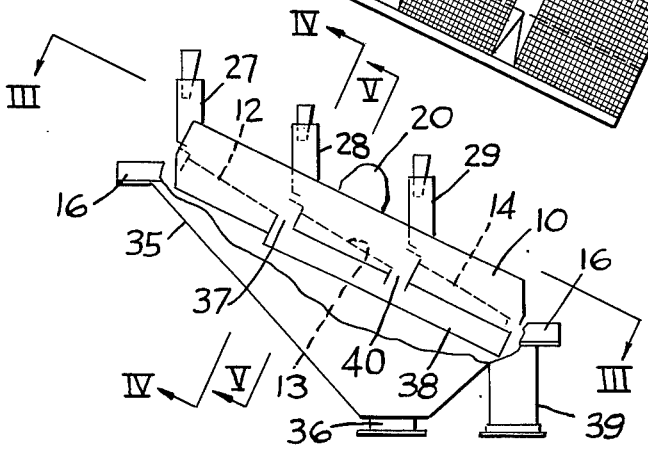
FIG. 2 is a similar somewhat schematic view of the screen portion of the apparatus of FIG. 1.
Figure 4:
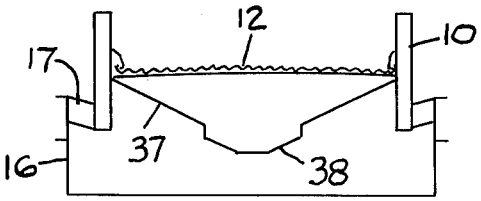
FIG. 4 is a transverse cross-sectional view taken on the line IV—IV of FIG. 2.

A funnel-like member 40 similar to that designated 37 in FIGS. 2 and 4 is provided at the lower end of screen 13 and discharges oversize material from screen 13 into launder 38. The oversize material from screen 14 passes off of the end thereof into a similar funnel-like member and is then deposited directly into outlet conduit 39.

A minor portion of the undersize material which passes through screens 13 and 14 will fall to the upper surface of the launder 38 but the contour of this surface and the vibration of the apparatus will cause this screened material to fall from the launder to the hopper 35.

A preferred embodiment of this invention having been hereinabove described and illustrated in the drawings, it is to be understood that numerous modifications thereof can be made without departing from the broad spirit and scope of this invention as defined in the appended claims.

We claim:

1. Screening apparatus comprising a plurality of screens in generally end-to-end relation but with spaces between the ends of adjacent screens whereby oversize material falls from corresponding ends of the several screens, means for depositing substantially uniform quantities of material to be screened at the opposite ends of the several screens, a funnel-like hopper beneath the several screens for receiving the undersize material which passes through the screens and converging the same to a common discharge conduit, a conduit for discharging oversize material from the several screens extending generally lengthwise of the apparatus beneath the screens, and guide means at the ends of the several screens for receiving oversize material falling therefrom for converging such material in a lateral direction and directing the same into said discharge conduit, said oversize material discharge conduit being substantially narrower than the width of said screens to permit the undersize material to fall past said conduit to said hopper.

2. Screening apparatus according to claim 1 including means above said screens for receiving a continuous flow of material to be screened, dividing the same into equal parts corresponding to the number of screens, and discharging the several parts onto the several screens.

3. Screening apparatus according to claim 1 wherein each of the several screens is inclined in a longitudinal direction whereby material being screened flows therealong from the high end to the low end.

4. Screening apparatus according to claim 3 including means above said screens for receiving a continuous flow of material to be screened, dividing the same into equal parts corresponding to the number of screens, and discharging the several parts onto the several screens adjacent to the high ends thereof.

5. Screening apparatus according to claim 3 including transversely extending funnel-like members at the low ends of the several screens for receiving and converging the flow of oversize material in a lateral direction for delivery to said longitudinal conduit.

6. Screening apparatus according to claim 1 including transversely extending funnel-like members at the discharge ends of the several screens for receiving and converging the flow of oversize material in a lateral direction for delivery to said longitudinal conduit.

* * * * *